US005121760A

United States Patent [19]

Ward

[11] Patent Number: 5,121,760

[45] Date of Patent: Jun. 16, 1992

[54] FINGERNAIL GUARD

[76] Inventor: Becky J. Ward, 310 The Village, #108, Redondo Beach, Calif. 90277

[21] Appl. No.: 757,339

[22] Filed: Sep. 10, 1991

[51] Int. Cl.[5] ..... A45D 29/00

[52] U.S. Cl. ..... 132/73

[58] Field of Search ..... 132/73, 285

[56] References Cited

U.S. PATENT DOCUMENTS

| | | | |
|---|---|---|---|
| 1,238,046 | 8/1917 | Nuss | 132/73 |
| 2,563,689 | 8/1951 | Muhlhauser | 132/73 |
| 3,487,831 | 1/1970 | Jaume et al. | 132/73 |
| 4,408,622 | 10/1983 | Meyerhoffer et al. | 132/73 |
| 4,625,740 | 12/1986 | Roth | 132/73 |
| 4,960,138 | 10/1990 | Kling | 132/73 |
| 4,962,731 | 10/1990 | Wexler | 132/73 |

*Primary Examiner*—Gene Mancene
*Assistant Examiner*—Michael Lynch
*Attorney, Agent, or Firm*—Hawes & Fischer

[57] ABSTRACT

A fingernail guard to be attached to a fingernail and comprising a pair of opposing sides that are coextensively joined to one another at a fold line therebetween. The sides are hingedly connected to and bent downwardly from said fold line to form an envelope in which to receive and thereby insulate a portion of the fingernail against cracking, chipping and similar damage. Each side of the fingernail guard includes a plurality of projections extending from the fold line. The projections are spaced from one another and adapted to rotate relative to the fold line and to each other to enable the shape of the nail guard to conform to the contour of the wearer's fingernail when the opposing sides of the nail guard are attached to respective sides of the wearer's nail and the fold line embraces the outer edge of said nail.

9 Claims, 1 Drawing Sheet

FINGERNAIL GUARD

BACKGROUND OF THE INVENTION

1. Field of the Invention

This invention relates to a decorative and protective fingernail guard which is to be bonded to the tip of a natural or artificial fingernail to provide the nail with both protection against chipping and cracking and an optional decorative appearance.

2. Background Art

It is well known that women like to grow their fingernails long for a variety of reasons. By way of example, long fingernails are often desirable to enhance one's appearance, particularly if the fingernails are polished or colored. However, because of their length, such fingernails are subject to chipping or cracking due to either an improper diet, impact with a solid object, biting, and the like. Consequently, the nail may become uneven, fragmented or broken. In some cases, a woman may have to file her nail down in order to repair the damage. In other cases, the woman may be forced to cut her nail when the extent of the damage is too great to permit easy repair. In either event, the shape and size of the nail are undesirably changed to cause a corresponding change in the woman's appearance.

It would therefore be desirable to provide a wearer with a low cost fingernail guard that may be easily bonded to a fingernail to preserve the appearance thereof by protecting the tip against chipping, cracking and related damage.

It would also be desirable, but not required, that the fingernail guard be provided with a decorative design by which to enhance the ornamental appearance of the nail to which said guard is bonded.

SUMMARY OF THE INVENTION

In general terms, a decorative and protective fingernail guard for a wearer's fingernail is disclosed which is to be bonded to the tip of the fingernail to resist chipping or cracking as a consequence of an impact with a solid object. The fingernail guard is formed from a continuous strip of flexible material that is either molded, pressed or stamped into an arcuate shape to conform to the shape of the tip of the fingernail. The guard is preferably manufactured from a thin layer of either transparent plastic (e.g. vinyl) or a reflective metallic foil. The guard is bonded to the wearer's nail by means of a commercially available adhesive commonly used with artificial nails. A decorative design may be applied to the nail guard (e.g. by means of either paint or a decal) to enhance the ornamental appearance thereof.

The nail guard includes a pair of opposing sides that are coextensively and hingedly joined to one another along a fold line, around which the guard is bent to easily and accurately position the sides thereof at respective sides of the wearer's fingernail. Each side of the fingernail guard has a plurality of projections which extend from the fold line and are separated from one another by voids. Thus, when the nail guard if affixed to the tip of a fingernail with the fold line embracing the outer edge of said tip, some of the projections can be rotated into the voids, when the curvature is greatest, so as to permit the guard to better conform to the shape of the fingernail without wrinkling or buckling.

DETAILED DESCRIPTION

Figure 1:
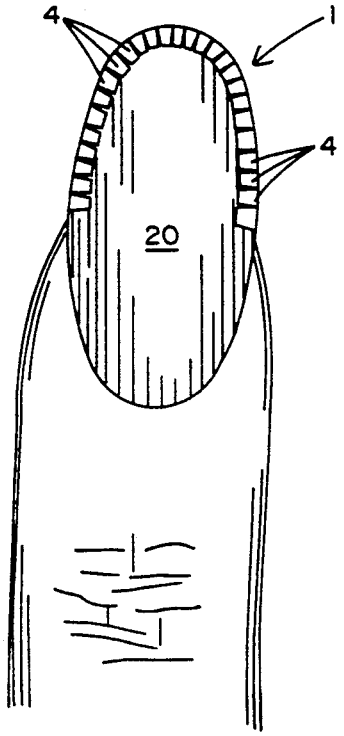
FIG. 1 shows the fingernail guard of the present invention affixed to the tip of a fingernail of a wearer.
Figure 2:
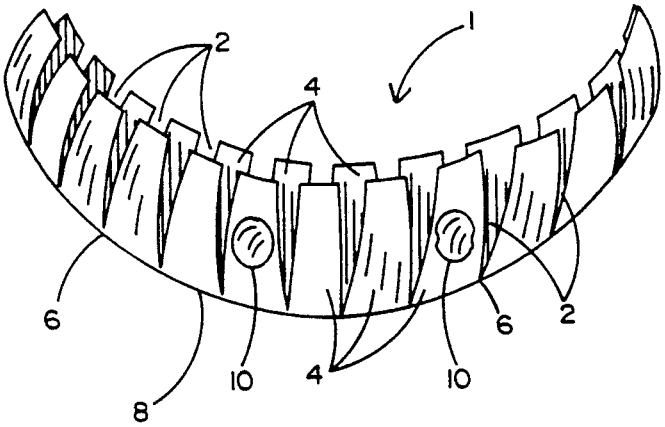
FIG. 2 is a perspective view of the fingernail guard of FIG. 1 prior to affixation to a fingernail.
Figure 3:
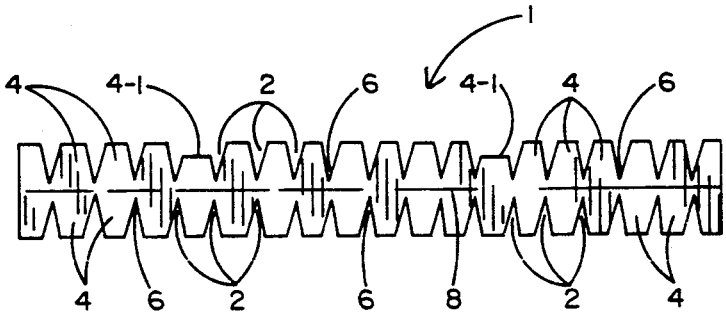
FIG. 3 shows the fingernail guard of FIG. 2 in an unfolded condition.

The fingernail guard 1 which forms the present invention is now disclosed in detail while referring concurrently to FIGS. 1–3 of the drawings. Fingernail guard 1 is formed from a continuous strip of flexible material that is molded, pressed or stamped so as to assume an arcuate shape. That is to say, the fingernail guard 1 is curved to conform to the contour of the tip of a wearer's natural or artificial fingernail 20 to which guard 1 will be affixed, as will soon be explained. Fingernail guard 1 is preferably manufactured from a thin layer of either plastic (e.g. vinyl) or metallic foil. The plastic may be transparent, particularly when it is desirable that the nail guard go substantially undetected after being affixed to the wearer's fingernail 20. The metallic foil will be typically opaque and adapted to reflect light to provide a contrast with the underlying color of the wearer's fingernail 20. Whether the guard is manufactured from vinyl, metallic foil, or other suitable material, decorative designs, designated 10, may be applied thereto, such as by means of paint, self-adhering decal, or the like. Such decorative designs enhance the ornamental appearance of the fingernail 20 while the fingernail guard 1 provides a structural reinforcement to the tip. The decorative design 10 may be applied prior to or after guard 1 is bonded to the wearer's fingernail 20.

To enable the fingernail guard 1 to closely follow the contour of the outside edge of a fingernail to which it is to be affixed, triangular or similarly shaped areas are removed (e.g. cut) therefrom to establish voids 2. Thus, the nail guard 1 will have such voids 2 located between successive pairs of finger-like projections 4. By virtue of the foregoing, fingernail guard 1 will be better adapted to bend, without wrinkling or buckling, so as to enable the wearer to selectively vary the radius of curvature of nail guard 1 according to the shape of the particular fingernail to which said nail guard is to be affixed. That is to say, a hinge or pivot point 6 is created at the intersection of each pair of adjacent projections 4. Thus, nail guard 1 may be bent at any one or more of such hinges 6 to permit projections 4 to rotate into the voids 2 therebetween. Therefore, and as is best shown in FIG. 1, where nail guard 1 is affixed to fingernail 20, certain ones of the projections 4 are rotated relative to one another into near side-by-side engagement with adjacent projections at the top of the wearer's nail 20, where the degree of curvature will be the greatest. In this case, the voids 2 between adjacent projections are partially or totally eliminated. Likewise, other projections 4 of nail guard 1 need be rotated relative to one another only slightly, or not at all, at the sides of the nail 20, where the degree of curvature will be the least. Here, the shape of the voids 2 between adjacent projections 4 is, for the most part, unchanged.

As is best illustrated in FIGS. 2 and 3, the fingernail guard 1 comprises a pair of opposing sides that are coextensively joined to one another at a center or fold line 8 to form an open-ended envelope in which to receive the tip of the wearer's fingernail. More particularly, the sides of fingernail guard 1 are bent downwardly from the fold line 8 during manufacture so that each side thereof will lie adjacent a respective side of the wearer's fingernail with fold line 8 following the outside edge thereof, as best shown in FIG. 1. Thus, fold line 8, from which the projections 4 extend, permits the fingernail guard 1 to be easily and accurately positioned on the fingernail 20, while preserving the curvature of said guard 1. What is more, this opposing sides of fingernail guard 1 act to insulate or buffer the tip of the fingernail against damage, such as cracking, chipping, and the like, due to an unintended contact with a solid object.

The fingernail guard 1 may be bonded to the tip of a natural or artificial fingernail 20 by any suitable commercially available adhesive that is also used to affix artificial nails to fingernails. By way of example only, one suitable adhesive which may be applied to the underside of the nail guard 1 to enable the opposing sides thereof to be bonded to a fingernail (e.g. 20) is that known as Nailene Ultra Nail Glue available from Pacific World Corporation of Huntington Beach, California.

In the embodiment disclosed above, fingernail guard 1 is preferably symmetrical relative to the fold line 8. That is, nail guard 1 has two identically shaped sides that are hingedly and coextensively joined to one another along the fold line 8 therebetween. However, it may be desirable to alter the shape of one side of the nail guard 1 relative to the opposing side. For example, certain ones of the projections (designated 4–1 in FIG. 3) may be made shorter in length than other projections 4. This may be done to vary the ornamental appearance of the side of nail guard 1 which is to be affixed to the outside of a fingernail 20. Alternatively, the length of the projections 4 to be affixed to the underside of fingernail 20 may be selected, depending upon the amount of adhesive needed and the surface area required to properly and securely bond fingernail guard 1 to nail 20.

While a preferred embodiment of the present invention has been shown and described, various modifications and changes may be made without departing from true spirit and scope of the invention. For example, the fingernail guard 1 has been described as having particular application to a fingernail. However, it is to be understood that this same nail guard 1 may also be bonded to a toenail, such as that found on the big or large toe of a wearer. Accordingly, the reference to nail guard 1 as a fingernail guard is not to be regarded as a limitation of the present invention, and it is to be specifically understood that the guard herein disclosed and claimed may also have suitable application as a toenail guard.

Having thus set forth the preferred embodiment of the invention, what is claimed is:

1. A fingernail guard to be attached to a wearer's fingernail to reduce the possibility of chipping and cracking, said nail guard surrounding the outer edge of the nail to which said guard is to be attached and comprising a pair of opposing sides coextensively jointed to one another at a fold line, the sides of said nail guard bending downwardly from said fold line to form an envelope in which to receive an protect a portion of the wearer's fingernail when said guard is attached to the nail and said fold line embraces the outer edge of said nail, at least one of the opposing sides of said guard including a plurality of projections extending outwardly from said fold line, said projections being spaced from and pivotal relative to one another and adapted to rotate into the spaces therebetween when said guard is attached to the wearer's fingernail.

2. The fingernail guard recited in claim 1 wherein at least some of said projections are longer than other projections.

3. The fingernail guard recited in claim 1, wherein the spaces between said projections are triangular shaped.

4. The fingernail guard recited in claim 1, wherein each of the opposing sides of said guard comprises a plurality of projections extending outwardly from said fold line, said projections being spaced from and pivotal relative to one another and adapted to rotate into the spaces therebetween when said guard is attached to the wearer's fingernail.

5. The fingernail guard recited in claim 4, wherein at least some of the projections of one of said sides are longer than some of the projections of the opposing side.

6. The fingernail guard recited in claim 1, further comprising a decorative design applied to said flexible material.

7. The fingernail guard recited in claim 1, wherein said piece of flexible material is a transparent vinyl.

8. The fingernail guard recited in claim 1, wherein said piece of flexible material is a reflective metal foil.

9. A fingernail guard to be attached to a fingernail and comprising a pair of opposing sides coextensively joined to one another at a fold line therebetween and bending downwardly from said fold line to form an envelope in which to receive and thereby insulate a portion of the fingernail against cracking, chipping and related damage, each of said opposing sides including a plurality of projections extending from said fold line, said projections being spaced from one another and adapted for rotation relative to said fold line and to each other to enable the shape of said nail guard to conform to the contour of the wearer's fingernail when the opposing sides of said guard are attached to respective sides of the nail and the fold line embraces the outer edge of said nail.

* * * * *